US010518283B2

(12) United States Patent
Boulais

(10) Patent No.: US 10,518,283 B2
(45) Date of Patent: Dec. 31, 2019

(54) DISPENSING HEAD

(71) Applicant: GB DEVELOPPEMENT, Vernon (FR)

(72) Inventor: Guillaume Boulais, Levallois Perret (FR)

(73) Assignee: GB DEVELOPPEMENT, Vernon (FR)

( * ) Notice: Subject to any disclaimer, the term of this patent is extended or adjusted under 35 U.S.C. 154(b) by 0 days.

(21) Appl. No.: 15/766,207

(22) PCT Filed: Oct. 7, 2016

(86) PCT No.: PCT/EP2016/074059
§ 371 (c)(1),
(2) Date: Apr. 5, 2018

(87) PCT Pub. No.: WO2017/060466
PCT Pub. Date: Apr. 13, 2017

(65) Prior Publication Data

US 2018/0281003 A1 Oct. 4, 2018

(30) Foreign Application Priority Data

Oct. 8, 2015 (FR) ..... 15 59583

(51) Int. Cl.
*B05B 11/00* (2006.01)

(52) U.S. Cl.
CPC ..... *B05B 11/3064* (2013.01); *B05B 11/007* (2013.01); *B05B 11/0062* (2013.01);
(Continued)

(58) Field of Classification Search
CPC ..... B05B 11/3064; B05B 11/0062; B05B 11/3033; B05B 11/3032
See application file for complete search history.

(56) References Cited

U.S. PATENT DOCUMENTS 2,562,317 A * 7/1951 Krall ..... B05B 11/3032 222/207
5,871,126 A * 2/1999 Bennett ..... B05B 11/007 222/207

(Continued)

FOREIGN PATENT DOCUMENTS

EP 0930101 A2 7/1999
FR 3005459 A1 11/2014

(Continued)

OTHER PUBLICATIONS

International Search Report for corresponding App. No. PCT/EP2016/074059, dated Jan. 18, 2017.

*Primary Examiner* — Jeremy Carroll
(74) *Attorney, Agent, or Firm* — Renner, Otto, Boisselle & Sklar, LLP

(57) ABSTRACT

A dispensing head including:

Figure 1:
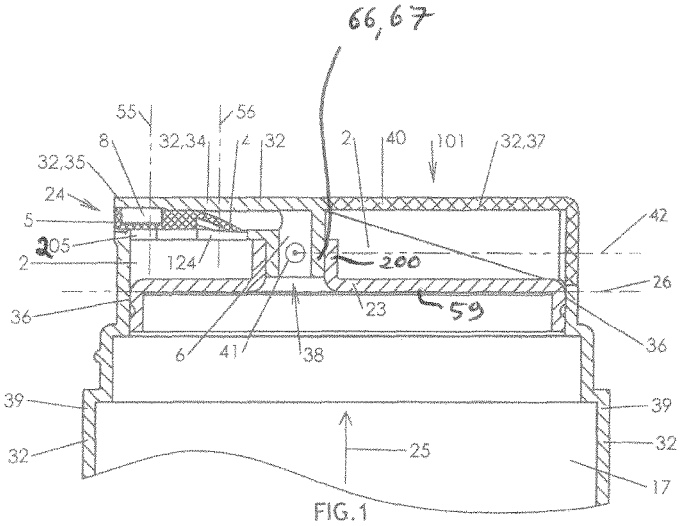

a cap having: an outer wall with at least one part referred to as the shell part and at least one part referred to as the pressing part that is made of a material more flexible than the at least one shell part; at least one outlet; an insertion orifice, a stopper, the stopper being mounted in the cap by being inserted into the cap from the insertion orifice side and in an insertion direction, at least one assembly, each assembly comprising: an inlet, passing through the stopper; a deformable pocket, an interior volume of which is intended to contain the fluid of this assembly and is delimited at least in part by the at least one pressing part of the cap; preferably a feed duct and/or a dispensing duct.

19 Claims, 6 Drawing Sheets

(52) U.S. Cl.
CPC ..... *B05B 11/3032* (2013.01); *B05B 11/3033* (2013.01); *B05B 11/3081* (2013.01)

(56) References Cited

U.S. PATENT DOCUMENTS

2008/0118299 A1* 5/2008 Py ..... B65D 47/18
2008/0223875 A1* 9/2008 LaFlamme ..... B05B 11/3032
222/135

FOREIGN PATENT DOCUMENTS

WO WO-2005046882 A1 * 5/2005 ..... B05B 11/3032
WO 2010/131042 A1 11/2010

* cited by examiner

DISPENSING HEAD

TECHNICAL FIELD

The present invention relates to a dispensing head. It also relates to a dispenser equipped with such a head.

Such a head allows a user to dispense a fluid (liquid, gel, etc.). The field of the invention is more particularly, but not limited, to that of dispensers of cream, soap, cosmetics, medical packaging or food products.

STATE OF THE ART

Various devices are known for dispensing liquids.

A first problem of this type of device lies in its lack of simplicity of use and in its ergonomics. For example, you have to squeeze a reservoir (tube-type of cream) to get out liquid and the liquid must be collected with a finger far from the pressure zone. Thus, it is not always easy to use such a device with one hand.

A second problem of this type of device lies in its complexity of implementation. For example, such a device can sometimes comprise too many parts to assemble and/or at least one piece that is not easy to insert among the constituent elements of said device.

The object of the present invention is to solve at least one of the above-mentioned problems.

DISCLOSURE OF THE INVENTION

This objective is achieved with a dispensing head, comprising:

- a cap comprising:
  - an outer wall comprising at least one referred to as the shell part and at least one referred to as the pressing part made of a material that is more flexible than the at least one shell part,
  - at least one outlet,
  - an insertion orifice,
- a stopper, the cap and the stopper being arranged so that the stopper is mounted in the cap according to an insertion arrangement in the cap on the side of the insertion orifice and in an insertion direction.

The outer wall may comprise side walls and an upper wall, the side walls forming a tube extending substantially in the insertion direction. The tube may have a height smaller than its diameter, of round, rectangular or other shape. The tube formed by the side walls may comprise two ends, comprising:

- a first end stopped by the upper wall, and
- a second end ending with the insertion orifice The at least one pressing part may comprise one or more pressing parts disposed on the side walls and the at least one outlet may comprise an outlet disposed on the side walls, the head according to the invention is preferably arranged so that a pressing on the or each pressing part disposed on the side walls causes an output of the fluid through the outlet disposed on the side walls.

The at least one pressing part may comprise one or more pressing parts disposed on the side walls and the at least one outlet may comprise an outlet disposed on the upper wall, the head according to the invention is preferably arranged so that a pressing on the or each pressing part disposed on the side walls causes an output of the fluid through the outlet disposed on the upper wall.

The pressing and shell parts of the cap may be joined in one part obtained by bi-injection or overmolding.

The cap may comprise two pressing parts on either side of the cap.

The head according to the invention may further comprise at least one assembly, each assembly comprising:

- An inlet, passing through the stopper, so that the assembly is arranged to conduct a fluid along a fluid flow path from the inlet of this assembly to the at least one outlet,
- A deformable pouch whose interior volume is arranged to contain the fluid of this assembly and is delimited at least partly by the at least one pressing part of the cap,
- Optionally, a feed pipe arranged to conduct the fluid of this assembly from the inlet of this assembly into the interior volume of the pouch of this assembly, and/or a dispensing pipe arranged to conduct the fluid of this assembly from the interior volume of the pouch of this assembly and to the at least one outlet.

For each assembly, it can then exist:

- a straight line perpendicular to the insertion direction and which passes through the outer wall of the cap and then through the interior volume of the pouch of this assembly and then through a partition wall between the inside volume of the pouch of this assembly and the dispensing pipe of this assembly then through the inside of the dispensing pipe of this assembly, and/or
- a straight line perpendicular to the insertion direction and which passes through the outer wall of the cap and then through the interior volume of the pouch of this assembly and then through a partition wall between the inside volume of the pouch of this assembly and the feed pipe of this assembly then through the interior of the feed pipe of this assembly.

For at least one or for each assembly, the dispensing pipe of this assembly may be located at least partly in the thickness of the outer wall of the cap.

For at least one or for each assembly, the dispensing pipe of this assembly may be located at least partly inside the stopper.

For at least one or for each assembly, the dispensing pipe of this assembly may pass through the pouch of this assembly.

For at least one or for each assembly, the dispensing pipe of this assembly may be straight.

The inner volume of each deformable pouch may be further delimited partly by the stopper.

For at least one or for each assembly, the dispensing pipe of this assembly may be located inside the cap and on the same side of a junction plane as the at least one outlet, this junction plane being defined as the plane, perpendicular to the insertion direction and the lowest relative to the insertion direction, passing through a boundary between the stopper and the internal volume of the pouch of this assembly.

For at least one or for each assembly, the feed pipe of this assembly may be located inside the cap and on the same side of a junction plane as the at least one outlet, this junction plane, being defined as the plane perpendicular to the insertion direction and the lowest relative to the insertion direction, passing through a boundary between the stopper and the internal volume of the pouch of this assembly.

For at least one or for each assembly, the feed pipe of this assembly may be located at least partly inside the stopper.

For at least one or for each assembly, the feed pipe of this assembly can pass through the pouch of this assembly.

The head according to the invention may comprise two or more distinct assemblies defining two distinct flow paths, the flow paths of the several or two assemblies opening preferably on the same outlet and being located inside the same cap.

The head according to the invention may comprise for at least one assembly or for each assembly:

- a feed valve, which, in an open state, allows passage of fluid of the feed pipe of this assembly to the inside of the pouch of this assembly, and, in a closed state, does not allow it, and or
- a dispensing valve which, in an open state, allows passage of fluid from the inside of the pouch of this assembly to the dispensing pipe of this assembly, and in a closed state does not allow it.

For at least one assembly or for each assembly, the dispensing valve of this assembly comprises a movable part (for example membrane) which:

- in the closed state of this dispensing valve, is kept pressed (preferably sufficiently firmly, by means of return means or a return spring) against a stationary (and rigid) part of the head (of an inner wall of the dispensing pipe in which this dispensing valve is housed), preferably of the cap or the stopper, called dispensing seat, and
- in the open state of this dispensing valve, parts from this dispensing seat.

At least one point of this dispensing seat is preferably at a distance of less than six (or even three) millimeters:

- from the outlet on which opens the fluid flow path of this assembly or
- from the outside of the head according to the invention through this outlet.

According to yet another aspect of the invention, there is provided a dispenser, characterized in that it comprises:

- a dispensing head according to the invention, and
- for each inlet, a separate reservoir connected to this inlet.

DESCRIPTION OF FIGURES AND EMBODIMENTS

Figure 2:
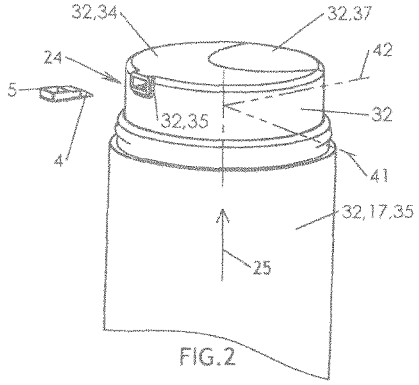
Figure 3:
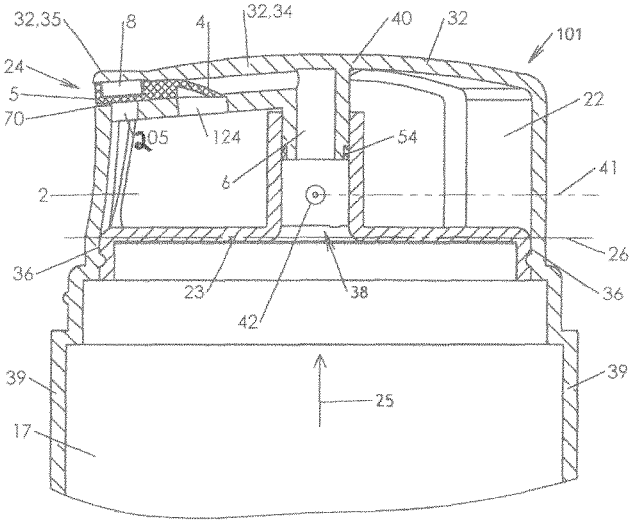
Figure 4:
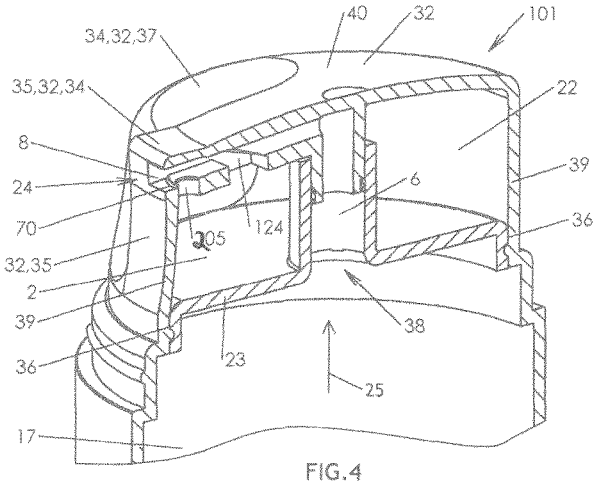
Figure 5:
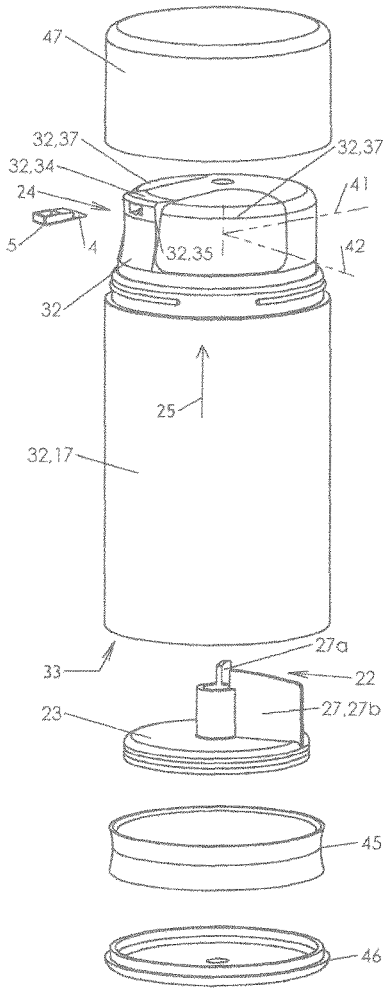
Figure 6:
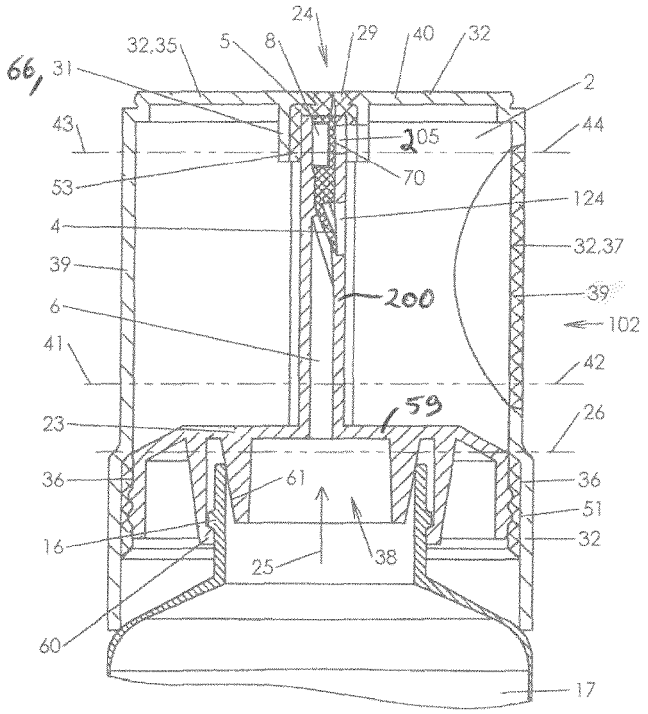
Figure 7:
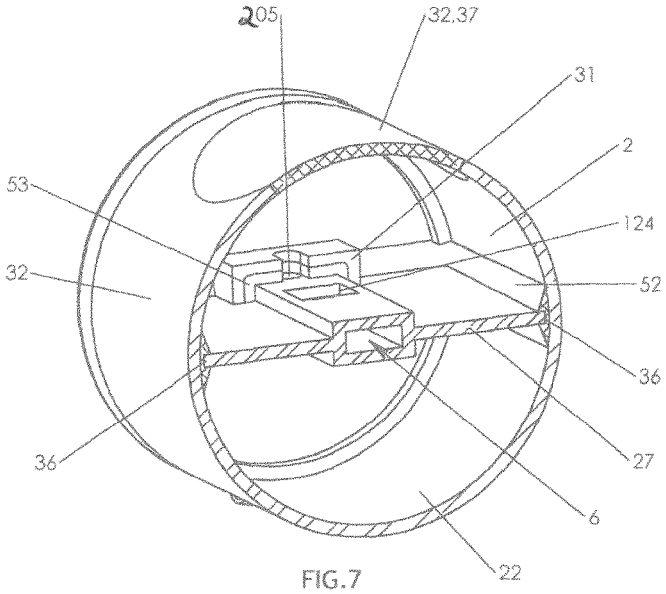
Figure 8:
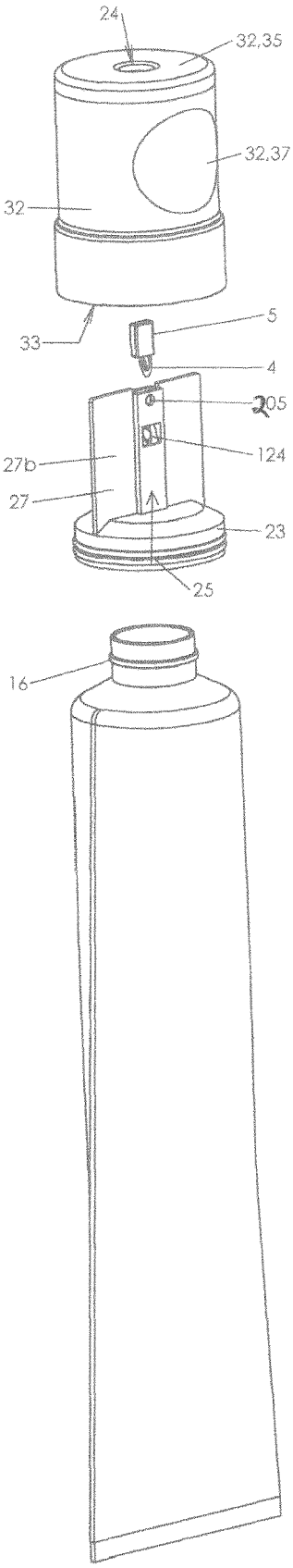
Figure 9:
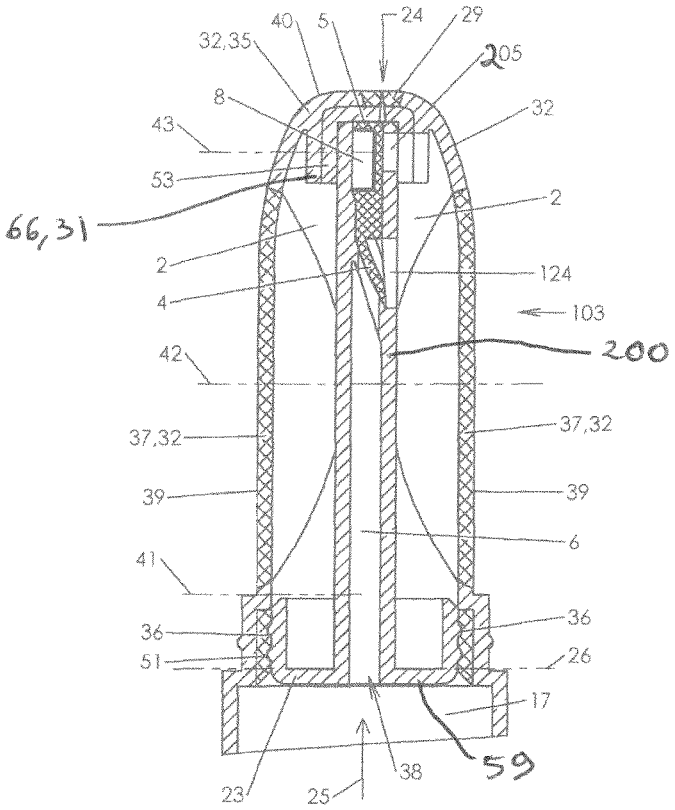
Figure 10:
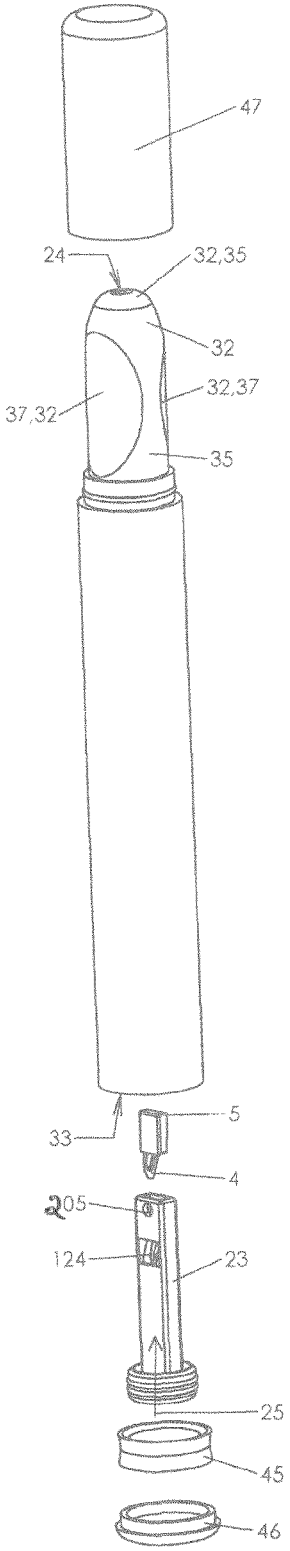
Figure 11:
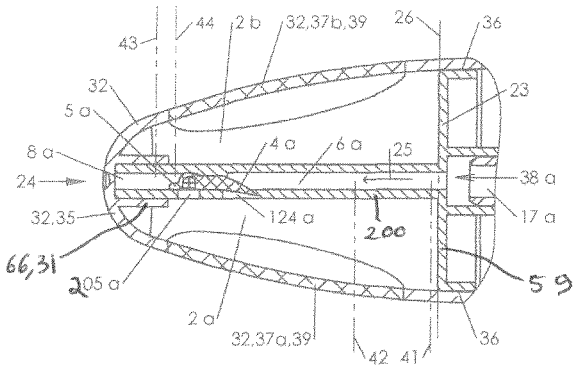
Figure 12:
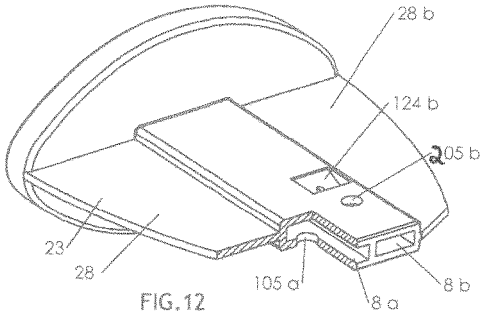
Figure 13:
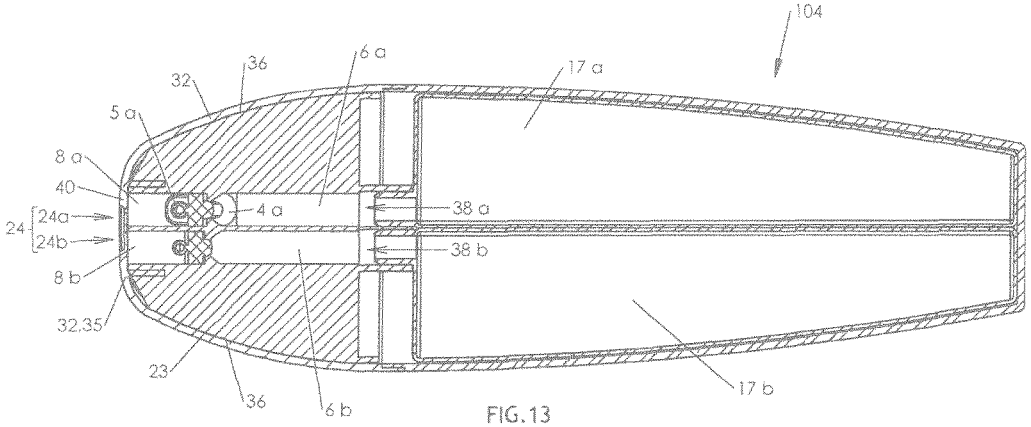
Figure 14:
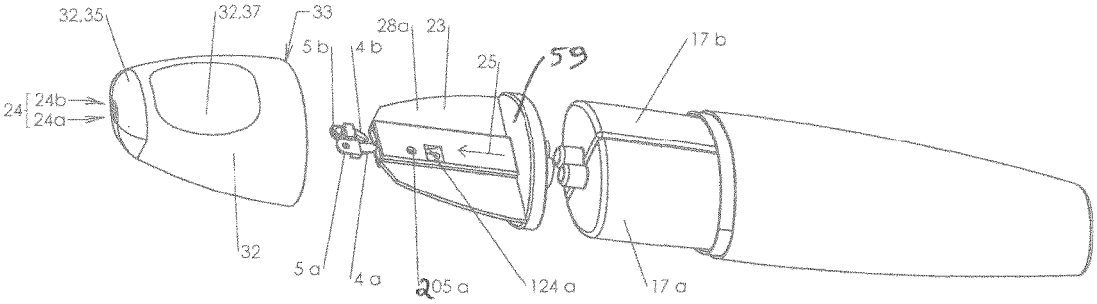
Figure 15:
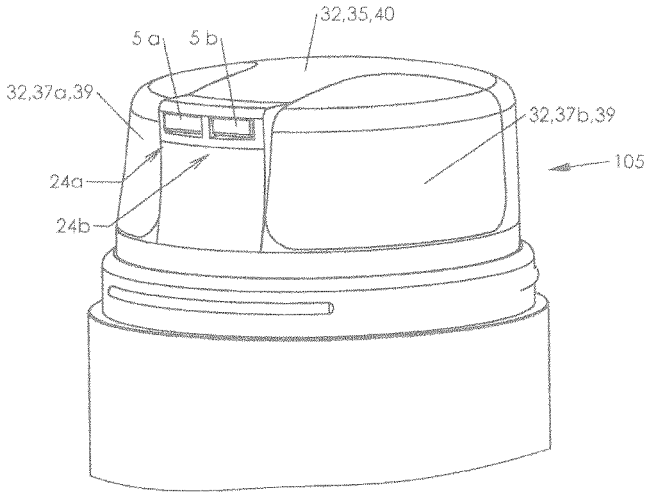
Figure 16:
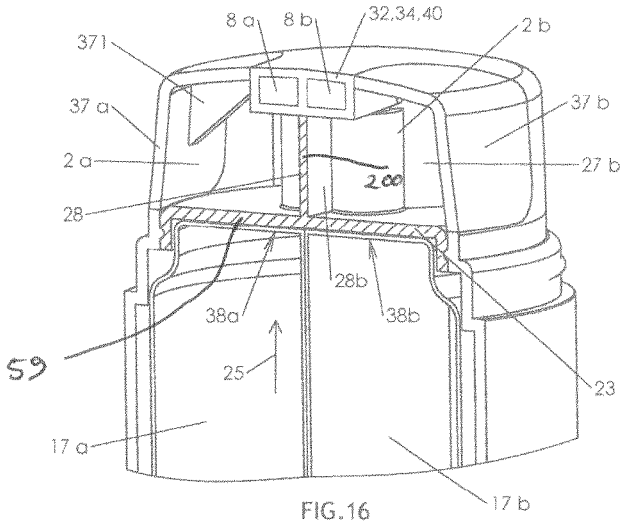
Figure 17:
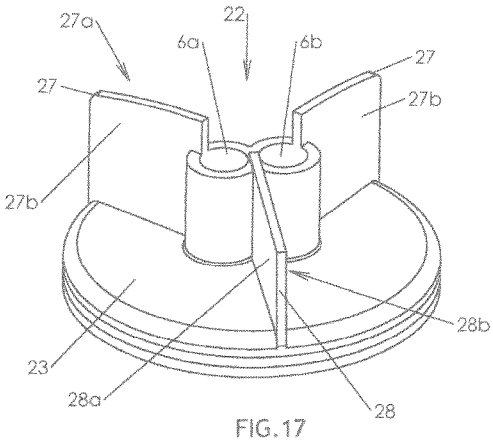
Figure 18:
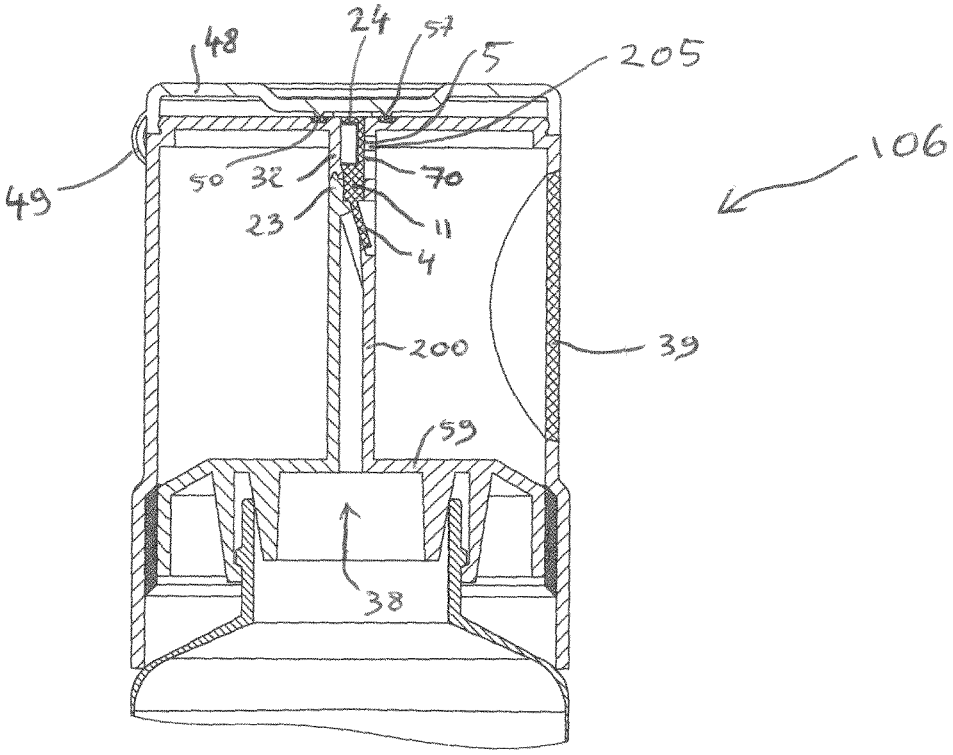
Figure 19:
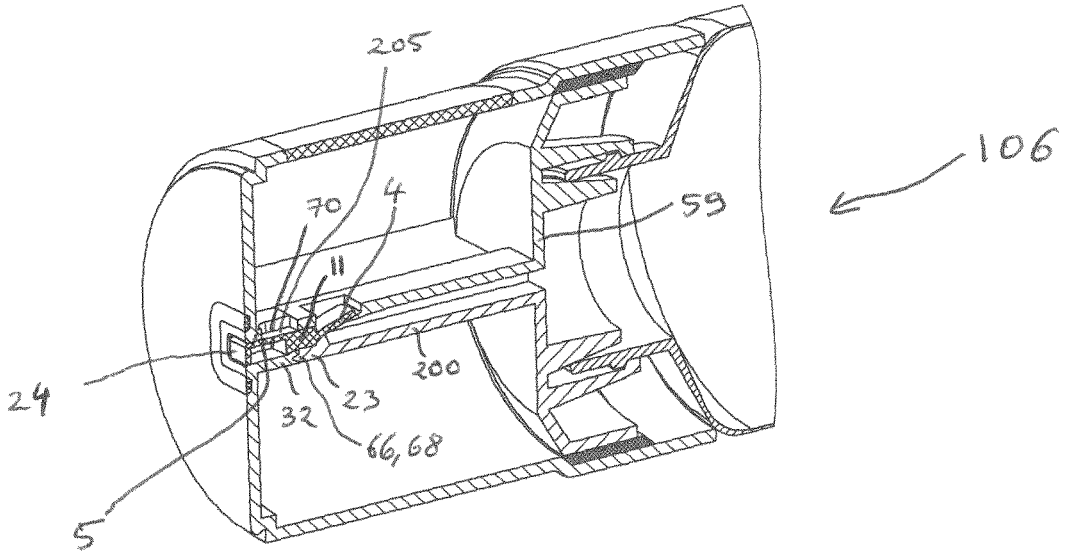

Other advantages and particularities of the invention will become apparent on reading the detailed description of implementations and embodiments that are in no way limiting, and the following attached drawings:

FIG. 1 is a profile sectional view of a first variant of a first embodiment of a head according to the invention, FIG. 2 is a perspective view of various "disassembled" or "exploded" elements comprised in the first variant of the first embodiment of the head according to the invention, FIG. 3 is a sectional view of a second variant of the first embodiment of the head according to the invention, which is a preferred embodiment of the invention;

FIG. 4 is a perspective sectional view of the second variant of the first embodiment of the head according to the invention (without the valves 4, 5 for a better visibility), FIG. 5 is a perspective view of various "disassembled" or "exploded" elements comprised in the second variant of the second (sic) embodiment of the head according to the invention in a dispenser according to the invention, FIG. 6 is a profile sectional view of a second embodiment of a head according to the invention, FIG. 7 is a perspective sectional view of the second embodiment of the head according to the invention, FIG. 8 is a perspective view of various "disassembled" or "exploded" elements comprised in the second embodiment of the head according to the invention in a dispenser according to the invention, FIG. 9 is a profile sectional view of a third embodiment of a head according to the invention, FIG. 10 is a perspective view of various "disassembled" or "exploded" elements comprised in the third embodiment of the head according to the invention in a dispenser according to the invention, FIG. 11 is a profile sectional view of a fourth embodiment of a head according to the invention, FIG. 12 is a perspective view of part of a stopper 23 of the fourth embodiment of the head according to the invention, FIG. 13 is a profile sectional view of various elements comprised in the fourth embodiment of the head according to the invention in a dispenser according to the invention, according to a section plane perpendicular to the sectional plane of FIG. 11, FIG. 14 is a perspective view of various "disassembled" or "exploded" elements comprised in the fourth embodiment of the head according to the invention in a dispenser according to the invention, FIG. 15 is a perspective view of a fifth embodiment of a head according to the invention, FIG. 16 is a front sectional view of the fifth embodiment of the head according to the invention, FIG. 17 is a perspective view of the cap 23 of the fifth embodiment of the head according to the invention, FIG. 18 is a sectional view of a sixth embodiment of a head according to the invention, and FIG. 19 is a perspective sectional view of the sixth embodiment of the head according to the invention.

These embodiments are in no way limiting, it is possible to consider variants of the invention comprising only a selection of characteristics described or illustrated below isolated from the other characteristics described or illustrated (even if this selection is isolated within a sentence comprising other characteristics), if this selection of characteristics is sufficient to confer a technical advantage or to differentiate the invention from the state of the prior art. This selection comprises at least one, preferably functional, characteristic without structural details, and/or with only a part of the structural details if this part alone is sufficient to provide a technical advantage or to differentiate the invention from the state of the prior art.

With reference to FIGS. 1 to 14, in all embodiments of dispensing head according to the invention 101, 102, 103 or 104 which will be described later, this dispensing head comprises a cap 32 and a stopper 23 (manufactured for example polypropylene (PP).

Such a head 101, 102, 103, 104 is arranged to dispense at least one fluid (this fluid typically comprising a liquid or a paste-like substance gel or cream).

The cap 32 comprises an outer wall 34 (39, 40).

The outer wall 34 comprises side walls 39 and an upper wall 40.

The outer wall 34 comprises (on its side walls 39 and/or its upper wall 40) at least one referred to as the shell part 35.

The outer wall 34 comprises (on its side walls 39 and/or its upper wall 40) at least one referred to as the pressing part 37 made of a more flexible material (typically a thermoplastic elastomer (TPE) or a copolymer of octene and ethylene) than the material (typically polypropylene (PP)) of the at least one shell part 35.

Each pressing part 37 may also comprise a thinner polypropylene (PP) wall of the order of 0.1 mm to 0.3 mm which may optionally be covered with an external overmolding of flexible material.

Each pressing part 37 preferably comprises a rib 371 (illustrated for example in FIG. 16), inside the cap 32, allowing a good mechanical strength of this pressing part 37. In addition, this rib is supported on a rigid part 35 inside the cap 32.

In the present description, "flexible matter" or "flexible material" will be understood to mean any material that is more flexible or less hard than the material of the at least one shell part 35 (the two hardnesses compared being measured in a same unit among Shore A or Shore D).

The pressing parts 37 and the shell parts 35 of the cap 32 are joined in one part obtained by bi-injection or overmolding. In a variant not shown, the pressing parts 37 and the shell parts 35 of the cap 32 are two separate parts inserted into one another, for example a flexible "sock" 37 inserted into a shell 35.

The cap 32 comprises at least one outlet 24 on the outer wall of the cap 32. The outlet 24 is the outlet of the part forming the cap 32 and leading to the outside of the cap 32. Optionally, an intermediate piece may be disposed between the outlet 24 and the outside of the dispensing head according to the invention, like, for example, an accessory (preferably mobile) such as a rotating dispensing ball (or "roll-on" in English) or a brush.

The cap 32 comprises an insertion orifice 33.

The cap 32 and the stopper 23 are arranged so that the stopper 23 is mounted in the cap 32 according to an insertion arrangement in the cap 32 on the side of the insertion orifice 33 and in an insertion direction 25.

The stopper 23 is mounted inserted in the cap 32, being held in the cap 32 and can exit the cap 32 and re-enter the cap 32 through the orifice 33.

The side walls 39 extend:

according to the insertion direction 25 or substantially in the insertion direction, preferably in a direction having at least one component in the insertion direction 25, preferably in a direction having at least one major component in the insertion direction (ie forming an angle less than 45° to the insertion direction 25).

The side walls 39 form a tube extending in the insertion direction 25 or substantially in the insertion direction 25.

By "substantially" in the insertion direction 25 it is meant:

that the tube and/or the side walls 39 extends at least according to a component in the insertion direction 25, and optionally with other complementary components, and that it is a general or average way of extending the tube and/or the side walls 39.

The tube formed by the side walls 39 has two ends:

a first end of the side walls 39 is stopped by the top wall 40 which preferably extends perpendicularly to the insertion direction 25 or substantially perpendicularly to the insertion direction 25 and a second end of the side walls 39 terminates with the insertion orifice 33.

The stopper 23 is held by a tightening force exerted by the cap 32 (more exactly by the side walls 39) around the cap 23 in the form of tightening forces perpendicular or substantially perpendicular to the insertion direction 25.

In addition, there is preferably flexible material 51 (in the same material as the part or parts 37) interposed in an intermediate zone 36 situated between the rigid part 35 and the stopper 23 is preferably provided. This makes it possible to improve the sealing and/or reducing visible deformations outside the cap 32.

Preferably, this flexible material 51 is part of the cap 32, is located under the rigid part 35 and is manufactured (during the bi-injection) at the same time as the pressing part(s) 37.

The stopper 23 is equipped with connection means (clipping means, no screws, etc.) having at least one reservoir or tube 17;

In all embodiments of dispensing head according to the invention 101, 102, 103 or 104 which will be described later, this dispensing head comprises at least one assembly, each assembly comprising:

an inlet 38, passing through the stopper 23, so that the assembly is arranged to conduct a fluid along a fluid flow path from the inlet 38 of this assembly to outlet 24 or one of the outlets 24; this inlet 38 is equipped with connection means (clipping means, no screws, etc.) with a reservoir 17 (for example a tube) specific to this assembly;

a deformable pouch 2, an interior volume is arranged to contain the fluid with this assembly and is delimited (at least partly) by the or one of the pressing parts 37 of the cap 32; this or each of these pressing part(s) 37 delimiting (at least partly) the internal volume of this pouch 2 is arranged to reduce the internal volume of the pouch 2 when pressing the pressing part 37 from outside the head 101, 102, 103 or 104; the internal volume of this deformable pouch 2 is further delimited partly by the stopper 23; this deformable pouch 2 is arranged to be in contact with the fluid of this assembly.

a feed pipe 6 arranged to conduct the fluid of this assembly from the inlet 38 of this assembly into the interior volume of the pouch 2 of this assembly, a feed orifice 124 connecting the pouch 2 of this assembly to the feed pipe 6 of this assembly, a feed valve 4, which, in an open state (obtained when a pressure exerted from outside the head 101, 102, 103, 104 is released on a pressing part 37 delimiting the internal volume of the pouch 2 of this assembly), allows passage of fluid from the feed pipe 6 of this assembly to the inside of the pouch 2 of this assembly through the feed orifice 124 of this assembly, and in a state closed (obtained when one exerts a pressure from the outside of the head 101, 102, 103, 104 on a pressing part 37 defining the interior volume of the pouch 2 of this assembly), does not allow it; the feed valve 4 of this assembly comprises a membrane which, in the closed state of this feed valve 4, is pressed against the feed orifice 124 of this assembly so as to plug this feed orifice 124 and in the open state of this feed valve 4, moves away from the feed orifice 124 of this assembly so as to open this feed orifice 124; the feed valve 4 of this assembly is an independent piece of the cap 32 and the stopper 23 (and the feed pipe 6 of this assembly), and is housed (at least its membrane) on the side of the pouch 2 this assembly;

a dispensing pipe 8 arranged to conduct the fluid of this assembly from the interior volume of the pouch 2 of this assembly and to the outlet 24 or one of the outlets 24, a dispensing orifice 205 connecting the pouch 2 of this assembly to the dispensing pipe 8 of this assembly, a dispensing valve 5 which, in an open state (obtained when exerting a pressure exerted from the outside of the head 101, 102, 103, 104 on a pressing part 37 delimiting the interior volume of the pouch 2 of this assembly), allows passage of fluid from the inside of the pouch 2 of this assembly to the dispensing pipe 8 of this assembly through the dispensing orifice 205 of this assembly, and, in a closed state (obtained when releasing a pressure exerted from the outside of the head 101, 102, 103, 104 on a pressing part 37 delimiting the interior volume of the pouch 2 of this assembly), does not allow a passage of fluid from the inside of the pouch 2 of this assembly to the dispensing pipe 8 of this assembly;

the dispensing valve 5 of this assembly is an independent piece of the cap 32 and the stopper 23 (and the dispensing pipe 8 of this assembly) and is housed (entirely) inside the dispensing pipe 8 of this assembly; the dispensing valve 5 of this assembly comprises a membrane which, in the closed state of this dispensing valve 5, is pressed against the dispensing orifice 205 of this assembly so as to plug this dispensing orifice 205, and in the open state of this dispensing valve 5, moves away from the dispensing orifice 205 of this assembly so as to open this dispensing orifice 205.

For at least one or for each assembly, the dispensing orifice 205 of this assembly is located on a side wall of the dispensing pipe 8 of this assembly, so that the dispensing orifice 205 of this assembly, the dispensing pipe 8 of this assembly and the dispensing valve 5 of this assembly are arranged so that the fluid of this assembly travels globally (that is to say on a larger scale than the swirls of the fluid microparticles) at a right angle or substantially a right angle passing from the pouch 2 of this assembly to the dispensing pipe 8 of this assembly, that is to say between the direction of the fluid at the inlet of the dispensing valve 5 of this assembly and the direction fluid at the outlet of the dispensing valve 5 of this assembly.

It will be noted that in all the figures and embodiments described, the dispensing valve 5, 5*a*, 5*b* (movable between its closed and open positions) is, in its closed state, kept pressed (sufficiently firmly, by means of return means or a return spring of the valve 5, 5*a* or 5*b* for example as described in the patent WO2012/010793) against a stationary part (called dispensing seat 70, which surrounds at least partially the periphery of the dispensing orifice 205 associated) and "rigid" (ie not made of flexible material) of an inner wall of the dispensing pipe 8, 8*a*, 8*b* respectively in which it is housed. More specifically, the dispensing valve 5, 5*a*, 5*b* respectively comprises a membrane which, in the closed state of the dispensing valve, is kept pressed against the dispensing seat 70, and parts from this seat in its open state. It should further be noted that the dispensing seat 70 is a lateral part of the dispensing pipe 8, 8*a*, 8*b* respectively, that is to say that this seat 70 is limited to one face, preferably one plane, of a internal wall of dispensing pipe 8, 8*a*, 8*b* respectively, and does not all around a section of the dispensing pipe 8, 8*a*, 8*b* respectively which would be realized in a plane perpendicular to the direction of elongation of the pipe 8, 8*a*, 8*b* respectively. At least one point of this seat 70 of the valve 5, 5*a*, 5*b* is at a distance (along a straight line) less than 6 mm (preferably less than 3 mm):

from the outside of the head 101, 102, 103, 104 or 105 passing the outlet 24, 24*a*, 24*b* respectively or the outlet 24, 24*a*, 24*b* respectively.

For at least one or for each assembly, the feed orifice 124 of this assembly is located on a side wall of the feed pipe 6 of this assembly, so that the feed orifice 124 of this assembly, the feed pipe 6 of this assembly and the feed valve 4 of this assembly are arranged so that the fluid of this assembly travels globally at a right angle or substantially a right angle passing from the feed pipe 6 of this assembly to the pouch 2 of this assembly, that is to say between the direction of the fluid at the inlet of the feed valve 4 of this assembly and the direction of the fluid at the outlet of the feed valve 4 of this assembly.

For at least one or for each assembly, the feed valve 4 of this assembly and the dispensing valve 5 of this assembly are connected by a junction element 11, this feed valve 4, this dispensing valve 5 and the junction element 11 being integral and in a unique piece 12 (manufactured for example a thermoplastic elastomer (TPE) or an octene and ethylene copolymer). This unique piece 12 is monoblock. The junction element 11 typically has a hardness of 70-80 Shore A. One hole creates a passage between the dispensing pipe 8 of this assembly and the feed pipe 6 of this assembly without passing through the pouch 2 of this assembly. The junction element 11 plugs this hole and is held by tightening in this hole.

Once the head 101, 102, 103 or 104 installed within a dispenser according to the invention, each inlet 38 of an assembly is connected to a fluid reservoir 17 which is specific to this inlet 38 and which preferably comprises the fluid of this assembly.

For each assembly, there are:

a straight line 41, perpendicular to the insertion direction 25, and which passes (preferably without any other intermediate element situated between the elements mentioned below) through the outer wall (more exactly a shell part 35) of the cap 32 then through the interior volume of the pouch 2 of this assembly and then through a wall (side wall of the feed pipe 6 of this assembly) of partition between the interior volume of the pouch 2 of this assembly and the feed pipe 6 of this assembly then through the interior of the feed pipe 6 of this assembly not parallel (but preferably perpendicular) to the direction of elongation (at the level of the intersection between this straight line 41 and the pipe 6) of this feed pipe 6, and/or a straight line 42, perpendicular to the insertion direction 25, and which passes (preferably without any other intermediate element situated between the elements mentioned below) through the outer wall (more exactly a pressing part 37) of the cap 32 and then through the interior volume of the pouch 2 of this assembly and then through a wall (side wall of the feed pipe 6 of this assembly) of partition between the interior volume of the pouch 2 of this assembly and the feed pipe 6 of this assembly then through the interior of the feed pipe 6 of this assembly not parallel (but preferably perpendicular) to the direction of elongation (at the level of the intersection between this straight line 42 and this pipe 6) of this feed pipe 6, and/or a straight line 43, perpendicular to the insertion direction 25, and which passes (preferably without any other intermediate element situated between the elements mentioned below) through the outer wall (more exactly a shell part 35) of the cap 32 then through the interior volume of the pouch 2 of this assembly and then through a wall (side wall of the dispensing pipe 8 of this assembly) of partition between the interior volume of the pouch 2 of this assembly and the dispensing pipe 8 of this assembly then through the interior of the dispensing pipe 8 of this assembly not parallel (but preferably perpendicular) to the direction of elongation (at the level of the intersection between this straight line 43 and this pipe 8) of this pipe dispensing 8, and/or a straight line 44, perpendicular to the insertion direction 25, and which passes (preferably without any other intermediate element situated between the elements mentioned below) through the outer wall (more exactly a pressing part 37) of the capp 32 then through the interior volume of the pouch 2 of this assembly and then through a wall (side wall of the dispensing pipe 8 of this assembly) of partition between the interior volume of the pouch 2 of this assembly and the dispensing pipe 8 of this assembly then through the inside of the dispensing pipe 8 of this assembly not parallel (but preferably perpendicular) to the direction of elongation (at the level of the intersection between this straight line 44 and the pipe 8) of this dispensing pipe 8, and/or a straight line 55 parallel to the insertion direction 25, and which passes (preferably without any other intermediate element situated between the elements mentioned below) through the outer wall 34 (more exactly a shell part 35 of the upper wall 40) of the cap 32 and then through the inside of the dispensing pipe 8 of this assembly not parallel (but preferably perpendicularly) to the direction of elongation (at the level of the intersection between this straight line 55 and this pipe 8) of this dispensing pipe 8 and then either through a wall (side wall of the dispensing pipe 8 of this assembly) of partition between the interior volume of the pouch 2 of this assembly and the dispensing pipe 8 of this assembly or through the orifice 205, then through the interior volume of the pouch 2 of this assembly, and/or a straight line 56 parallel to the insertion direction 25, and which passes (preferably without any other intermediate element situated between the elements mentioned below) through the outer wall 34 (more exactly a shell part 35 of the upper wall 40) of the cap 32 and then through the interior of the feed pipe 6 of this assembly not parallel (but preferably perpendicularly) to the direction of elongation (at the level of the intersection between this straight line 56 and this pipe 6) of this feed pipe 6 and then either through a wall (side wall of the feed pipe 6 of this assembly) of partition between the internal volume of the pouch 2 of this assembly and the feed pipe 6 of this assembly or through the orifice 124, then through the interior volume of the pouch 2 of this assembly.

For at least one or for each assembly:

the dispensing pipe 8 of this assembly is located at least partly (preferably entirely) inside the cap 32 and/or at least partly (preferably entirely) inside the stopper 23, the entire dispensing pipe 8 of this assembly being located distributed inside the cap 32 and inside the stopper 23, the part of the dispensing pipe 8 located in the cap 32 being arranged so that fluid flowing in this part of the dispensing pipe 8 is in contact with the cap 32 or the part of the dispensing pipe 8 located in the stopper 23 being arranged so that fluid flowing in this part of the dispensing pipe 8 is in contact with the stopper 23, The feed pipe 6 of this assembly is located at least partly (possibly entirely) inside the stopper 23 and/or at least partly (possibly entirely) inside the cap 32, the entire feed pipe 6 of this assembly being located distributed inside the cap 32 and inside the stopper 23, the part of the feed pipe 6 located in the stopper 23 being arranged so that fluid flowing in this part of the feed pipe 6 is in contact with the stopper 23, the part of the feed pipe 6 located in the cap 32 being arranged so that fluid flowing in this part of the feed pipe 6 is in contact with the cap 32 and the cap 32 and the stopper 23 are assembled (for example, by connecting or fitting together or clipping) at the level of the dispensing pipe 8 of this assembly (FIGS. 6 to 14) or the feed pipe 6 of this assembly (FIGS. 1 to 5), that is to say that it is the part of the dispensing pipe 8 of this assembly (FIGS. 6 to 14) made in the stopper 23 or the part of the feed pipe 6 of this assembly (FIGS. 1 to 5) made in the stopper 23 which connects or fits or clips together into the cap 32. In addition, there is preferably we preferably has the flexible material 53 and/or 54 (in the same material that of the part(s) 37) interposed between the rigid part 35 and the stopper 23 in this zone of connection or fitting or clipping (which corresponds for example to a collar 31 of the cap 32 which is depressed at least a part of the dispensing pipe 8 formed by the stopper 23). This improves the sealing. Preferably, this flexible material 53 and/or 54 is part of the cap 32, and is manufactured (during the bi-injection) at the same time as the pressing part or parts 37.

For at least one or for each assembly, the dispensing pipe 8 of this assembly is straight, without any angle along the fluid flow path from the dispensing valve 5 of this assembly and to the outlet 24 of this assembly (ie the outlet 24 which leads the flow path of this assembly).

For at least one or for each assembly, the feed pipe 6 of this assembly begins to extend parallel or substantially parallel to the insertion direction 25 from the inlet 38 of this assembly and to the pouch 2 of this assembly along the flow path of this assembly (but not necessarily up to this pouch 2).

In addition, for at least one or for each assembly, it is possible to define a plane of junction 26 as the plane:

perpendicular to the insertion direction 25 the lowest relative to the insertion direction 25 (the direction pointing upwards being defined as the insertion direction 25 and the direction pointing downwards being defined as the opposite of the insertion direction 25), and passing through a boundary (at least one point, preferably a line) between the stopper 23 and the interior volume of the pouch 2 of this assembly.

For at least one or for each assembly, the dispensing pipe 8 of this assembly, the dispensing orifice 205 of this assembly and/or the dispensing valve 5 of this assembly is (entirely) located inside of the cap 32 and on the same side of the junction plane 26 as the outlet 24 of this assembly.

For at least one or for each assembly, the feed pipe 6 of this assembly, the feed orifice 124 of this assembly and/or the feed valve 4 of this assembly is (entirely) located inside the cap 32 and on the same side of the junction plane 26 as the outlet 24 of this assembly.

For at least one or for each assembly, the pouch 2 of this assembly is (entirely) located inside the cap 32 and on the same side of the plane of junction 26 as the outlet 24 of this assembly.

We will first describe, with reference to FIGS. 1 to 5, a first embodiment of head 101 according to the invention in a dispenser according to the invention.

This embodiment only comprises one assembly 38, 2, 6, 8 (connected to its reservoir 17), but one could consider a variant with several assemblies.

For at least one or for each assembly, the dispensing pipe 8 of this assembly is located entirely inside the cap 32.

For at least one or for each assembly, the dispensing valve 5 of this assembly is located entirely inside the cap 32.

For at least one or for each assembly, the dispensing pipe 8 (and the dispensing valve 5) of this assembly is located at least partly (here entirely) in the thickness of the outer wall 34 of the cap 32 (here more exactly in the thickness of the upper wall 40).

For at least one or for each assembly, the feed pipe 6 of this assembly is located entirely inside the cap 32 (FIG. 1) or is entirely distributed inside the cap 32 and inside. stopper 23 (FIG. 3).

In the case of FIGS. 3 to 5, the stopper 23 comprises a partition 27 (comprising one or more separating lamellae) for limiting the volume of the deformable pouch 2 and forming an air pouch 22, in order to improve the return of the fluid. This partition has a face 27*a* arranged to be in contact with the internal volume of the air pouch 22 and a face 27*b* arranged to be in contact with the internal volume of the fluid pouch 2. The volume of the pouches 2 and 22 form the internal volume of the cap 32, except for the volume of the partition 27, and pipes 6, 8.

In the case of FIGS. 1 and 2 (and also in the case of FIGS. 3 to 5 if the optional partition 27 is removed), for at least one or for each assembly, the feed pipe 6 of this assembly passes through the pouch 2 of this assembly. In at least one plane (preferably perpendicular to the insertion direction 25), preferably in all planes (preferably perpendicular to the insertion direction 25) along the feed pipe 6 of this assembly for which this feed pipe 6 extends parallel to the insertion direction 25, the feed pipe 6 of this assembly is surrounded (360° around the pipe 6 of this assembly) by the interior volume of the pouch 2 of this together.

For at least one or for each assembly, the entire dispensing pipe 8 of this assembly is straight and extends perpendicularly or substantially perpendicularly to the insertion direction 25.

For at least one or for each assembly, the feed pipe 6 of this assembly forms an angle (preferably right angle) and extends:

- parallel or substantially parallel to the insertion direction 25 from the entrance 38 of this assembly toward the pouch 2 of this assembly along the flow path of this assembly up to a turn of this assembly, then
- perpendicularly or substantially perpendicular to the insertion direction 25 from the turn of this assembly toward the pouch 2 of this assembly along the flow path of this assembly up to this pouch 2.

The cap 32 comprises:

- a pressing part 37 which is distributed both on the side walls 39 and the upper wall 40 (FIG. 1), or
- two pressing parts 37 on either side of the cap 32, on the side walls 39, and at symmetrical or substantially symmetrical positions with respect to a plane parallel to the insertion direction 25 (FIG. 3), so that a pinch only on these two pressing parts 37 with forces carried by the same axis and equal in intensity but in opposite directions can simultaneously press the two pressing parts 37 without moving the head 101. These two pressing parts 37 are arranged to act on the volume of the same pouch 2 (reduce the volume during a pressing).

In the case of FIG. 1, the head 101 is arranged so that a pressing (preferably opposite the insertion direction 25) on the surface of the pressing 37 disposed on the upper wall 40 causes an output of the fluid through the outlet 24 disposed on the side walls 39 (preferably in accordance with a fluid output direction, at the level of this outlet 24, perpendicular or substantially perpendicular to the insertion direction 25).

In the case of FIG. 3, the head 101 is arranged so that a pressing (preferably perpendicular or substantially perpendicular to the insertion direction 25) on the (or each) surface of the pressing 37 disposed on the side walls 39 causes an output of the fluid through the outlet 24 disposed on the side walls 39 (preferably in accordance with a fluid output direction, at the level of this outlet 24, perpendicular or substantially perpendicular to the insertion direction 25).

In general (FIGS. 1 and 3), the angle between:

- the pressing direction on the surface of the pressing 37 (perpendicular to this surface of the pressing 37), and
- the output direction of the fluid through the outlet 24, is between 45° and 135°, preferably between 75° and 105°, and preferably equal to 90°.

Note that ("exploded" view of FIG. 5) in this embodiment, the dispenser according to the invention comprises only:

- the stopper 23,
- the cap 32,
- the part forming the valves 4 and 5 (mounted by insertion into the pipe 8 from the inlet 24 connected to this pipe 8)
- a piston 45 (made for example of polyethylene (PE)), going up in the reservoir 17 as the fluid of the reservoir 17 is consumed,
- optionally a cover 46 (made for example of polypropylene (PP)) clipped at the bottom of the dispenser to hide the piston 45,
- optionally a removable cover 47 (made for example of styrene-acrylonitrile copolymer (SAN)) arranged to cover the outlet 24.

Note that, in this embodiment, the outer wall 34 of the cap 32 (more precisely the side walls 39) forms part of the walls defining the internal volume of the reservoir 17 (in a variant not shown, the cap 32 is connected to an independent reservoir by clipping its side walls 39 on this reservoir 17).

We will now describe, with reference to FIGS. 6 to 8, a second embodiment of head 102 according to the invention in a dispenser according to the invention.

This embodiment only comprises one assembly 38, 2, 6, 8 (connected to its reservoir 17), but one could consider a variant with several assemblies.

For at least one or for each assembly, the dispensing pipe 8 of this assembly is located entirely inside the stopper 23.

For at least one or for each assembly, the dispensing valve 5 of this assembly is located entirely inside the stopper 23.

For at least one or for each assembly, the feed pipe 6 of this assembly is located entirely inside the stopper 23.

For at least one or for each assembly, the entire dispensing pipe 8 of this assembly is straight and extends parallel or substantially parallel to the insertion direction 25.

For at least one or for each assembly, the entire feed pipe 6 of this assembly is straight and extends parallel or substantially parallel to the insertion direction 25.

For at least one or for each assembly, the entire feed pipe 6 of this assembly and the entire dispensing pipe 8 of this assembly extend along the same axis (vertical in FIG. 6, parallel to the insertion direction 25).

The stopper 23 comprises a partition 27 (comprising one or more separating lamellae) for limiting the volume of the deformable pouch 2 and forming an air pouch 22, in order to improve the return of the fluid. This partition has a face 27*a* arranged to be in contact with the internal volume of the air pouch 22 and a face 27*b* arranged to be in contact with the internal volume of the fluid pouch 2. The volume of the pouches 2 and 22 form the internal volume of the cap 32, except for the volume of the partition 27, and the pipes 6, 8.

The stopper 23 comprises a clip 60 to be connected to a neck 16 of the reservoir 17.

The stopper 23 comprises a collar 61 with a slope (oblique with respect to the insertion direction 25) in order to ensure a seal.

In addition, there is preferably flexible material 52 (in the same material as the part or parts 37) interposed in the intermediate zone 36 situated between the cap 32 and the stopper 23, more exactly between the rigid part 35 (of the cap 32) and the edge of the partition 27 (which is part of the cap 23). This improves the sealing.

Preferably, this flexible material 52 is part of the cap 32, and is manufactured (during the bi-injection) at the same time as the pressing part(s) 37.

The cap 32 comprises a pressing part 37 on the side walls 39.

The head 102 is arranged so that a pressing (preferably perpendicular or substantially perpendicular to the insertion direction 25) on the surface of the pressing 37 disposed on the side walls 39 causes an output of the fluid through the outlet 24 disposed on the upper wall 40 (preferably in accordance with a fluid output direction, at the level of this outlet 24, parallel or substantially parallel to the insertion direction 25). In general, the angle between:

- the pressing direction, on the surface of the pressing 37 (perpendicular to this surface of the pressing 37), and
- the output direction of the fluid through outlet 24, is between 45° and 135°, preferably between 75° and 105°, and preferably equal to 90°.

With reference to FIG. 6, the periphery of the orifice of outlet 24 may be of flexible material 29 (preferably of the same material as the part(s) 37). Preferably, this flexible material 29 is part of the cap 32, and is manufactured (during the bi-injection) at the same time as the pressing part(s) 37. This flexible material 29 is arranged to close the outlet 24 in the absence of pressure exerted by a user on the one or more of the surfaces of the pressing 37.

We will now describe, with reference to FIGS. 9 to 10, a third embodiment of head 103 according to the invention in a dispenser according to the invention.

This embodiment only comprises a assembly 38, 2, 6, 8 (connected to its reservoir 17), but one could consider a variant with several assemblies.

For at least one or for all together, the dispensing pipe 8 of this assembly is located entirely inside the stopper 23.

For at least one or for each assembly, the dispensing valve 5 of this assembly is located entirely inside the stopper 23.

For at least one or for each assembly, the dispensing pipe 8 of this assembly passes through the pouch 2 of this assembly. In at least one plane (preferably perpendicular to the insertion direction 25), preferably in all planes (preferably perpendicular to the insertion direction 25) along the dispensing pipe 8 of this assembly (for example in starting from the dispensing orifice 205 of this assembly and up to the outlet 24 of this assembly), the dispensing pipe 8 of this assembly is surrounded (at 360° around the pipe 8 of this assembly) by the internal volume of pouch 2 of this assembly.

For at least one or for each assembly, the feed pipe 6 of this assembly is located entirely inside the stopper 23.

For at least one or for each assembly, the feed pipe 6 of this assembly passes through the pouch 2 of this assembly. In at least one plane (preferably perpendicular to the insertion direction 25), preferably in all planes (preferably perpendicular to the insertion direction 25) along the feed pipe 6 of this assembly (for example starting from the inlet 38 of this assembly and up to the feed orifice 124 of this assembly), the feed pipe 6 of this assembly is surrounded (at 360° around the pipe 6 of this assembly) by the inside volume of the pouch 2 of this assembly.

For at least one or for each assembly, the entire dispensing pipe 8 of this assembly is straight and extends parallel or substantially parallel to the insertion direction 25.

For at least one or for each assembly, the entire feed pipe 6 of this assembly is straight and extends parallel or substantially parallel to the insertion direction 25.

For at least one or for each assembly, all the feed pipe 6 of this assembly and all the dispensing pipe 8 of this assembly extend along the same axis (vertical in FIG. 9, parallel to the direction insertion 25).

The cap 32 comprises two pressing parts 37 on either side of the cap 32, on the side walls 39, and symmetrical or substantially symmetrical with respect to a plane parallel to the insertion direction 25, so that a pinch only on these two pressing parts 37 with forces carried by the same axis and equal in intensity but in opposite directions allows to simultaneously press the two pressing parts 37 without moving the head 103. These two pressing parts are arranged to act on the volume of the same pouch 2 (reduce the volume during a pressing).

The head 103 is arranged so that a pressing (preferably perpendicular or substantially perpendicular to the insertion direction 25) on the (or each) surface of the pressing 37 disposed on the side walls 39 causes an output of the fluid through the outlet 24 disposed on the upper wall 40 (preferably in accordance with a fluid output direction, at the level of this outlet 24, parallel or substantially parallel to the insertion direction 25). In general, the angle between:

- the pressing direction on the surface of the pressing 37 (perpendicular to this surface of the pressing 37), and
- the output direction of the fluid through the outlet 24, is between 45° and 135°, preferably between 75° and 105°, and preferably equal to 90°.

Note that ("exploded" view of FIG. 10) in this embodiment, the dispenser according to the invention comprises only:

- the stopper 23,
- the cap 32,
- the part forming the valves 4 and 5 (mounted by insertion into the pipe 8 directly into the stopper 23 without passing through the inlet 24)
- a piston 45 (made for example of polyethylene (PE)), going up in the reservoir 17 as the fluid of the reservoir 17 is consumed,
- optionally a cover 46 (made for example of polypropylene (PP)) clipped at the bottom of the dispenser to hide the piston 45,
- optionally a removable cover 47 (made for example of styrene-acrylonitrile copolymer (SAN)) arranged to cover the outlet 24.

Note that, in this embodiment, the outer wall 34 of the cap 32 (more precisely the side walls 39) forms part of the walls delimiting the internal volume of the reservoir 17.

With reference to FIG. 9, the periphery of the orifice of outlet 24 may be of flexible material 29 (preferably of the same material as the part(s) 37). Preferably, this flexible material 29 is part of the cap 32, and is manufactured (during the bi-injection) at the same time as the pressing part(s) 37. This flexible material 29 is arranged to close the outlet 24 in the absence of pressure exerted by a user on the one or more of the surfaces of the pressing 37.

Note also that this embodiment does not comprise line 44.

We will now describe, with reference to FIGS. 11 to 14, a fourth embodiment of head 104 according to the invention in a dispenser according to the invention.

The head 104 comprises two distinct assemblies defining two distinct flow paths, the flow paths of the two assemblies opening out respectively on outlets 24*a* and 24*b* and being located inside the same cap 32.

The reference numbers will be identical to those previously used for the same elements, but will only be split with the index <<a>> for the first assembly and <<b>> for the second assembly.

The outlets 24*a* and 24*b* form an outlet 24 common to the assembly 38*a*, 2*a*, 6*a*, 8*a* (connected to its reservoir 17*a*) and to the assembly 38*b*, 2*b*, 6*b*, 8*b* (connected to its reservoir 17*b*), which allows to automatically mix the different fluids.

The stopper 23 comprises a partition 28 (comprising one or more separating lamellae) arranged to delimit partly, inside the cap 32, the contour of the interior volume of different deformable pouches 2*a*, 2*b*.

This partition 28 has a face 28*a* arranged to be in contact with the interior volume of the pouch 2*a* and a face 28*b* arranged to be in contact with the interior volume of the pouch 2*b*.

The volume of the pouches 2*a* and 2*b* form the internal volume of the cap 32, except for the volume of the partition 28, and the pipes 6*a*, 6*b*, 8*a*, 8*b*.

The partition wall 28 comes from both sides of the pipes 6*a*, 6*b*, 8*a*, 8*b* and the edge of this partition 28 marries the inside of the cap 32 in a plane parallel to the insertion direction 25.

For at least one or for each assembly, the dispensing pipe 8*a* or 8*b* of this assembly is located entirely inside the stopper 23.

For at least one or for each assembly, the dispensing valve 5*a* or 5*b* of this assembly is located entirely inside the stopper 23.

For at least one or for each assembly, the feed pipe 6*a* or 6*b* of this assembly is located entirely inside the stopper 23.

For at least one or for each assembly, the entire dispensing pipe 8*a* or 8*b* of this assembly is straight and extends parallel or substantially parallel to the insertion direction 25.

For at least one or for each assembly, the entire feed pipe 6*a* or 6*b* of this assembly is straight and extends parallel to or substantially parallel to the insertion direction 25.

For at least one or for each assembly, the entire feed pipe 6*a* or 6*b* of this assembly and the entire dispensing pipe 8*a* or 8*b* of this assembly extend along the same axis (vertical in FIG. 11, parallel to the insertion direction 25).

The cap 32 comprises two pressing parts 37*a* and 37*b* on either side of the cap 32, on the side walls 39, and of symmetrical or substantially symmetrical positions with respect to a plane parallel to the insertion direction 25, so that a pinch only on these two pressing parts 37*a* and 37*b* with forces carried by the same axis and equal in intensity but in opposite directions allows to simultaneously press the two pressing parts 37*a* and 37 without moving the head 104. These two pressing parts 37*a*, 37*b* are arranged to act on the volume of only one of the pouches respectively 2*a* or 2*b* (decrease of the internal volume of 2*a* or 2*b* when pressing respectively on 37*a* or 37*b*).

The head 104 is arranged so that a pressing (preferably perpendicular or substantially perpendicular to the insertion direction 25) on the (or each) surface of the pressing 37*a*, 37*b* disposed on the side walls 39 causes an output of the fluid through the outlet 24 disposed on the upper wall 40 (preferably in accordance with a fluid output direction, at the level of this outlet 24, parallel or substantially parallel to the insertion direction 25). In general, the angle between:

- the pressing direction, on the surface of the pressing 37*a* or 37*b* (perpendicular to this surface of the pressing 37*a* or 37*b*), and
- the output direction of the fluid through the outlet 24, is between 45° and 135°, preferably between 75° and 105°, and preferably equal to 90°.

We will now describe, with reference to FIGS. 15 to 17, a fifth embodiment of head 105 according to the invention in a dispenser according to the invention.

The head 105 comprises two distinct assemblies defining two distinct flow paths, the flow paths of the two assemblies opening out respectively on the outlets 24*a* and 24*b* and being situated inside the same cap 32.

The reference numbers will be identical to those previously used for the same elements, but will only be split with the index <<a>> for the first assembly 38*a*, 2*a*, 6*a*, 8*a* (connected to its reservoir 17*a*) and <<b>> for the second assembly 38*b*, 2*b*, 6*b*, 8*b* (connected to its reservoir 17*b*).

For at least one or for each assembly, the dispensing pipe 8*a* or 8*b* of this assembly is located entirely inside the cap 32.

For at least one or for each assembly, the dispensing valve 5*a* or 5*b* of this assembly is located entirely inside the cap 32.

For at least one or for each assembly, the dispensing pipe 8*a* or 8*b* (and the dispensing valve 5*a* or 5*b*) of this assembly is located at least partly (here entirely) in the thickness of the outer wall 34 of the cap 32 (here more exactly in the thickness of the upper wall 40).

For at least one or for each assembly, the feed pipe 6*a* or 6*b* of this assembly is entirely distributed inside the cap 32 and inside the stopper 23.

The stopper 23 comprises:

- a partition 28 (comprising one or more separating lamellae) arranged to delimit partly, inside the cap 32, the contour of the internal volume of different deformable pouches 2*a*, 2*b* of the different assemblies 38*a*, 2*a*, 6*a*, 8*a* (connected to its reservoir 17*a*) and 38*b*, 2*b*, 6*b*, 8*b* (connected to its reservoir 17*b*). This partition 28 has a face 28*a* arranged to be in contact with the interior volume of the pouch 2*a* and a face 28*b* arranged to be in contact with the interior volume of the pouch 2*b*.
- a partition 27 (comprising one or more separating lamellae) to form an air pouch 22, in order to improve the return of the fluid. This partition has a face 27*a* arranged to be in contact with the interior volume of the air pouch 22 and a face 27*b* arranged to be in contact with the internal volume of the fluid pouch 2*a* or 2*b*.

The volume of the pouches 2*a*, 2*b* and 22 form the internal volume of the cap 32, except for the volume of the partitions 27, 28, and pipes 6*a*, 6*b*, 8*a*, 8*b*.

For at least one or for each assembly, the entire dispensing pipe 8*a* or 8*b* of this assembly is straight and extends perpendicularly or substantially perpendicular to the insertion direction 25.

For at least one or for each assembly, the feed pipe 6*a* or 6*b* of this assembly forms an angle (preferably straight) and extends:

- parallel or substantially parallel to the insertion direction 25 from the inlet 38*a* or 38*b* of this assembly toward the pouch 2*a* or 2*b* of this assembly along the flow path of this assembly up to a turn of this assembly, then
- perpendicularly or substantially perpendicularly to the insertion direction 25 from the turn of this assembly toward the pouch 2*a* or 2*b* of this assembly along the flow path of this assembly up to this pouch 2*a* or 2*b*.

The cap 32 comprises two pressing parts 37*a* and 37*b* on either side of the cap 32, on the side walls 39, and of symmetrical or substantially symmetrical positions with respect to a plane parallel to the insertion direction 25, so that a pinch only on these two pressing parts 37*a* and 37*b* with forces carried by the same axis and equal in intensity but in opposite directions allows to simultaneously press the two pressing parts 37*a* and 37 without moving the head 105. These two pressing parts 37*a*, 37*b* are arranged to act on the volume of only one of the pouches respectively 2*a* or 2*b* (decrease of the internal volume of 2*a* or 2*b* when pressing respectively on 37*a* or 37*b*).

The head 105 is arranged so that a pressing (preferably perpendicular or substantially perpendicular to the insertion direction 25) on the (or each) surface of the pressing 37*a*, 37*b* disposed on the side walls 39 causes an output of the fluid respectively through the outlet 24*a*, 24*b* disposed on the side walls 39 (preferably in accordance with a fluid output direction, at the level of this outlet 24*a* or 24*b*, perpendicular or substantially perpendicular to the insertion direction 25).

In general, the angle between:

- the pressing direction, on the surface of the pressing 37*a* or 37*b* (perpendicular to this surface of the pressing 37*a* or 37*b*), and
- the output direction of the fluid through the outlet respectively 24*a* or 24*b*, is between 45° and 135°, preferably between 75° and 105°, and preferably equal to 90°.

Note that in this embodiment, the dispenser according to the invention comprises only:

- the stopper 23,
- the cap 32,
- the piece forming the feed valves 4*a* (not shown) and the dispensing valves 5*a* (mounted by insertion in the pipe 8*a* from the inlet 24*a* connected to the pipe 8*a*)
- the part forming the feed valves 4*b* (not shown) and the dispensing valves 5*b* (mounted by insertion in the pipe 8*b* from the inlet 24*b* connected to the pipe 8*b*)
- a piston 45*a* (not shown, made for example of polyethylene (PE)), going up in the reservoir 17*a* as the fluid of the reservoir 17*a* is consumed,
- a piston 45*b* (not shown, made for example of polyethylene (PE)), going up in the reservoir 17*b* as the fluid of the reservoir 17*b* is consumed,
- optionally a cover 46 (not shown, made of, for example, polypropylene (PP)) clipped at the bottom of the dispenser to hide the pistons 45*a* and 45*b*,
- optionally a removable cover 47 (not shown, made of, for example, styrene-acrylonitrile copolymer (SAN)) arranged to cover the outlets 24*a* and 24*b*.

Note that, in this embodiment, the outer wall 34 of the cap 32 (more precisely the side walls 39) forms part of the walls delimiting the internal volume of each of the reservoirs 17*a* and 17*b* (in a not shown variant, the cap 32 is connected to two independent reservoirs by a clipping of its side walls 39 on these reservoirs 17*a*, 17*b*).

For the embodiment 105 each of the partition walls 27, 28 is a vertical wall which fits inside the cap 32 and is parallel to the insertion direction 25.

In a variant, the head 105 further comprises a cover (not shown) arranged to slide on the cap 32 so as to simultaneously actuate the flexible parts 37*a*, 37*b* of the chambers 2*a* and 2*b* in the case of the simultaneous dispensing of several liquids.

In this embodiment, the outlets 24*a* and 24*b* are close together, which corresponds to the case where the liquids are taken at the same time for a mixture on the skin for example. In a variant, one can:

- have more than two assemblies (three, four, etc.) with as many outlets 24*a*, 24*b*, 24*c*, 24*d*, etc., and/or
- set these different outlets strongly apart, especially in the case of different fluids that must be taken or distributed at different times (case of a morning cream, an afternoon cream and an evening cream from three different outlets 24*a*, 24*b*, 24*c* for example)

We will now describe, with reference to FIGS. 18 and 19, a sixth embodiment of head 106 according to the invention in a dispenser according to the invention.

This sixth embodiment 106 will only be described for its differences with respect to the embodiment of FIG. 6.

In this embodiment 106:

- the dispensing valve 5 is located inside the cap 32,
- the feed valve 4 is located inside the stopper 23, and
- the feed valve 4 and the dispensing valve 5 are connected by the connecting element 11, the feed valve 4, the dispensing valve 5 and the connecting element 11 being integral and in a single piece, the junction element 11 being located partly inside the cap 32 and partly inside the stopper 23, and being held by the stopper 23 and/or the cap 32.

The seat 70 is formed only of a stationary part of the cap 32. It may be noted that the orifice 205 is formed by the cap 32 and the stopper 23. The seat 70 is formed on the edge of the orifice 205 on the side of the cap 32. The orifice 205 next to the cap 32 is open so as to unmold the cap 32.

This embodiment 106 further comprises a hood 48 (not shown in FIG. 19), preferably connected to the cap 32 by a hinge 49.

This embodiment 106 comprises:

- a flexible form or seal 50, and
- a relief or protruding shape 57, one of these two elements being located on the cap 32 by surrounding the outlet 24, the other of these two elements being located on the hood 48, so that there is a closed position of the hood 48 (illustrated in FIG. 18) for which the relief 57 and the seal 50 are in contact, both surrounding the outlet 24.

The preferred embodiment is one in which the flexible form or seal 50 is located on the cap 32 without relief surrounding the outlet 24, and the relief or protruding shape 57 is located on the hood 48, so that there is a closed position of the hood 48 for which the relief 57 and the seal 50 are in contact, both surrounding the outlet 24.This allows a better recovery of the dispensed product by passing a finger on the outlet 24 when the cover 48 is in an open position (illustrated in FIG. 19 without the cover 48).

Note that in all the embodiments of FIGS. 1 to 19, the stopper 23 comprises:

- a bottom wall 59, through which passes the inlet 38 or the inlets 38*a* and 38*b* of each assembly, and extending perpendicular to the insertion direction 25 or in a direction having at least one component perpendicular to the direction insertion device 25, preferably in a direction having at least one major component perpendicular to the insertion direction (ie forming an angle of 90°±22.5° relative to the insertion direction 25), and
- a connection element 200 (typically a rod, walls of a pipe or a plate) which extends:
  - from the bottom wall 59 for the upper wall 40 of the cap 32 and preferably up to the upper wall 40 of the cap 32, in the insertion direction 25 or in a direction having at least one component in the insertion direction 25, preferably at least one major component in the insertion direction (ie forming an angle less than 45° to the insertion direction 25).

The element 200 is held in the cap 32 with a holding means 66 lying across the upper wall 40, this holding means 66 comprising, according to the embodiment in question:

a tube 67 of the cap 32 (FIG. 1) inserted into the element 200 a flange 31 of the cap 32 (FIGS. 6, 9 and 11) surrounding the element 200 pins and/or notches 68 (FIGS. 18, 19) between the two pipes 6, 8.

The wall 59 is rigid and is arranged not to deform, especially when pressing on the pressing part 37, 37*a*, 37*b* and use of the dispensing head.

The relative positions of the wall 59 and the shell 35 remain fixed, in particular when pressing on the pressing part 37, 37*a*, 37*b* and use of the dispensing head.

The junction between the connection element 200 and the wall 59 is fixed. The connection element 200 and the wall 59 are fixed to each other.

There is no interaction between the pouch 2 and the reservoir 17. The various embodiments of dispenser according to the invention illustrated are arranged so that, by deforming the internal volume of each pouch 2, 2*a*, 2*b*, does not deform the interior volume of the reservoir 17 or 17*a*, 17*b*. There is no common flexible wall between each pouch 2, 2*a*, 2*b*, and the reservoir 17, 17*a*, 17*b*.

In the embodiments of FIGS. 6 to 14, it is the element 200 that holds and/or encloses the valve 5, 5*a*, 5*b* and the valve 4, 4*a*, 4*b* in the pipe 6, 6*a*, 6*b* respectively.

The connecting member 200 may form, surround or carry the feed pipe 6, 6A, 6*b*. However, in variants not shown, the connecting member 200 may not form or surround or carry the feed pipe 6, 6*a*, 6*b*, particularly if the feed valve 4 is placed on the wall 59 and that the pipe 6, 6*a*, 6*b* disappears. In this case, there is no common flexible wall between each pouch 2, 2*a*, 2*b*, and the reservoir 17, 17*a*, 17*b* (with the exception of an intake valve 4 placed on the wall 59 between the cap 32 and the element 200)

Of course, the invention is not limited to the examples which have just been described and many adjustments can be made to these examples without departing from the scope of the invention.

For example, in a variant of the embodiment of FIG. 9, the dispensing valve 5 is moved to be integrated in the cap 32, more precisely in the flexible part 29 of the cap 32, more precisely in the flexible part 29 of the upper wall 40 of the cap 32. The flexible material 53 is removed, and the dispensing seat 70 is placed on the end of the element 200 of the stopper 23 which, by the removal of the part 53, and in contact with the dispensing valve 5, 29 at the level of the outlet 24. The dispensing valve 5 thus comprises a movable part which:

in the closed state of this dispensing valve 5, is maintained pressed against a stationary part of the head, more precisely against a stationary part (distal end of the element 200) of the cap 23, called the dispensing seat 70, and in the open state of this dispensing valve 5, it parts from this dispensing seat 70, at least one point of this dispensing seat 70 being at a distance of less than 6 or even 3 millimeters from the outlet 24 on which the fluid flow path opens.

Of course, the various features, shapes, variants and embodiments of the invention may be associated with each other in various combinations to the extent that they are not incompatible or exclusive of each other. In particular all the variants and embodiments described above are combinable with each other.

The invention claimed is:

1. A dispensing head, comprising a cap comprising:

an outer wall comprising at least one part referred to as a shell part and at least one part referred to as a pressing part made of a material that is more flexible than the at least one shell part, at least one outlet, an insertion orifice, a stopper, the cap and the stopper being arranged so that the stopper is mounted in the cap according to an insertion arrangement in the cap on the side of the insertion orifice and in an insertion direction, at least one assembly, each assembly comprising:

an inlet, passing through the stopper, so that the assembly is arranged to conduct a fluid along a fluid flow path from the inlet of this assembly to the at least one outlet, a deformable pouch, an internal volume of which is arranged to contain the fluid of this assembly and is delimited at least in part by the at least one pressing part of the cap, wherein the outer wall comprises side walls and an upper wall, the side walls forming a tube extending substantially in the insertion direction, the tube formed by the side walls comprising two ends comprising:

a first end stopped by the upper wall, and a second end terminating in the insertion orifice, wherein at least one assembly or each assembly includes a dispensing valve that comprises a movable part which:

in the closed state of this dispensing valve, is kept pressed against a stationary part, of the head, called the dispensing seat, and in the open state of this dispensing valve, parts from this dispensing seat, at least one point of this dispensing seat being at a distance of less than 6 millimeters from the outlet on which the fluid circulation path of this assembly opens.

2. The dispensing head according to claim 1, wherein the at least one pressing part comprises one or more pressing part(s) disposed on the side walls and in that the at least one outlet comprises one outlet disposed on the side walls, and wherein pressing on the or each pressing part disposed on the side walls causes an output of the fluid through the outlet disposed on the side walls.

3. The dispensing head according to claim 1, wherein the at least one pressing part comprises one or more pressing part(s) disposed on the side walls and in that the at least one outlet comprises one outlet disposed on the upper wall, and wherein pressing on the or each pressing part disposed on the side walls causes an output of the fluid through the outlet disposed on the upper wall.

4. The dispensing head according to claim 1, wherein each assembly further comprises:

a feed pipe arranged to conduct the fluid of this assembly from the inlet of this assembly into the interior volume of the pouch of this assembly, and/or a dispensing pipe arranged to conduct the fluid of this assembly from the interior volume of the pouch of this assembly and to the at least one outlet.

5. The dispensing head according to claim 4, wherein for each assembly, there are:

a straight line perpendicular to the insertion direction and which passes through the outer wall of the cap and then through the interior volume of the pouch of this assembly and then through a partition wall between the inside volume of the pouch of this assembly and the dispensing pipe of this assembly then through the inside of the dispensing pipe of this assembly, and/or a straight line perpendicular to the insertion direction and which passes through the outer wall of the cap and then through the interior volume of the pouch of this assembly and then through a partition wall between the interior volume of the pouch of this assembly and the feed pipe of this assembly then through the inside of the feed pipe of this assembly.

6. The dispensing head according to claim 4, wherein for at least one or for each assembly, the dispensing pipe of this assembly is located at least partly in the thickness of the outer wall of the cap.

7. The dispensing head according to claim 4, wherein for at least one or for each assembly, the dispensing pipe of this assembly is located at least partly inside the stopper.

8. The dispensing head according to claim 4, wherein for at least one or for each assembly, the dispensing pipe of this assembly passes through the pouch of this assembly.

9. The dispensing head according to claim 4, wherein for at least one or for each assembly, the dispensing pipe of this assembly is straight.

10. The dispensing head according to claim 4, wherein for at least one or for each assembly, the dispensing pipe of this assembly is located inside the cap and on the same side of a junction plane as the at least one outlet, this junction plane being defined as the plane, perpendicular to the insertion direction and the lowest in relation to the insertion direction, passing through a boundary between the stopper and the interior volume of the pouch of this assembly.

11. The dispensing head according to claim 4, wherein for at least one or for each assembly, the feed pipe of this assembly is located inside the cap and on the same side of a junction plane as the at least one outlet, this junction plane being defined as the plane, perpendicular to the insertion direction and the lowest in relative to the insertion direction, passing through a boundary between the stopper and the interior volume of the pouch of this assembly.

12. The dispensing head according to claim 4, wherein for at least one or for each assembly, the feed pipe of this assembly is located at least partly inside the stopper.

13. The dispensing head according to claim 4, wherein for at least one or for each assembly, the feed pipe of this assembly passes through the pouch of this assembly.

14. The dispensing head according to claim 4, wherein it comprises for at least one assembly or for each assembly:

a feed valve, which, in an open state, allows a fluid passage of the feed pipe of this assembly to the inside of the pouch of this assembly, and, in a closed state, do not allow it, and/or a dispensing valve which, in an open state, allows a passage of fluid from the inside of the pouch of this assembly to the dispensing pipe of this assembly, and, in a state closed does not allow it.

15. The dispensing head according to claim 1, wherein the internal volume of each deformable pouch is further delimited in part by the stopper.

16. The dispensing head according to claim 1, wherein the cap comprises two pressing parts on either side of the cap.

17. The dispensing head according to claim 1, wherein it comprises two distinct assemblies defining two distinct flow paths, the circulation paths of the two assemblies opening on the same outlet and being located at inside the same cap.

18. A dispenser, comprising:

the dispensing head according to claim 1, and for each inlet, a separate reservoir connected to this inlet.

19. The dispensing head according to claim 1, wherein the cap or the stopper includes the stationary part.

* * * * *